US006068071A

United States Patent [19]

Jurewicz

[11] Patent Number: 6,068,071

[45] Date of Patent: May 30, 2000

[54] CUTTER WITH POLYCRYSTALLINE DIAMOND LAYER AND CONIC SECTION PROFILE

[75] Inventor: Stephen R. Jurewicz, Los Angeles, Calif.

[73] Assignee: U.S. Synthetic Corporation, Orem, Utah

[21] Appl. No.: 08/804,092

[22] Filed: Feb. 20, 1997

Related U.S. Application Data

[60] Provisional application No. 60/018,263, May 24, 1996.

[51] Int. Cl.[7] ..... E21B 10/36

[52] U.S. Cl. ..... 175/432; 175/434

[58] Field of Search ..... 175/414, 420.1, 175/420.2, 425, 426, 428, 431, 432, 434

[56] References Cited

U.S. PATENT DOCUMENTS

| | | | |
|---|---|---|---|
| Re. 32,036 | 11/1985 | Dennis | 175/329 |
| 2,264,440 | 12/1941 | Havlick | 255/61 |
| 3,745,623 | 7/1973 | Wentorf, Jr. et al. | 29/95 |
| 3,767,371 | 10/1973 | Wentorf, Jr. et al. | 51/307 |
| 3,841,852 | 10/1974 | Wilder et al. | 51/295 |
| 3,871,840 | 3/1975 | Wilder et al. | 51/295 |
| 3,913,280 | 10/1975 | Hall | 51/307 |
| 4,098,362 | 7/1978 | Bonnice | 175/430 |
| 4,156,329 | 5/1979 | Daniels et al. | 51/295 |
| 4,268,276 | 5/1981 | Bovenkerk | 51/295 |
| 4,311,490 | 1/1982 | Bovenkerk et al. | 51/307 |
| 4,592,433 | 6/1986 | Dennis | 175/329 |
| 4,602,691 | 7/1986 | Weaver | 175/329 |
| 4,604,106 | 8/1986 | Hall et al. | 51/293 |
| 4,605,343 | 8/1986 | Hibbs, Jr. et al. | 407/119 |
| 4,629,373 | 12/1986 | Hall | 407/118 |
| 4,694,918 | 9/1987 | Hall | 175/329 |
| 4,764,434 | 8/1988 | Aronsson et al. | 428/565 |
| 4,784,023 | 11/1988 | Dennis | 76/108 A |
| 4,811,801 | 3/1989 | Salesky et al. | 175/329 |
| 4,830,123 | 5/1989 | Daly et al. | 175/431 |
| 4,913,247 | 4/1990 | Jones | 175/329 |
| 5,016,718 | 5/1991 | Tandberg | 175/333 |
| 5,120,327 | 6/1992 | Dennis | 51/293 |
| 5,135,061 | 8/1992 | Newton, Jr. | 175/428 |
| 5,154,245 | 10/1992 | Waldenstrom et al. | 175/420.2 |
| 5,158,148 | 10/1992 | Keshavan | 175/426 |
| 5,217,081 | 6/1993 | Waldenstrom et al. | 175/420.2 |
| 5,248,006 | 9/1993 | Scott et al. | 175/420.2 |
| 5,264,283 | 11/1993 | Waldstrom et al. | 428/408 |
| 5,273,125 | 12/1993 | Jurewicz | 175/420.2 |
| 5,279,375 | 1/1994 | Tibbitts et al. | 175/434 X |
| 5,316,095 | 5/1994 | Tibbitts | 175/429 |
| 5,335,738 | 8/1994 | Waldenstrom et al. | 175/420.2 |
| 5,351,772 | 10/1994 | Smith | 175/428 |
| 5,355,969 | 10/1994 | Hardy et al. | 175/432 |
| 5,379,854 | 1/1995 | Dennis | 175/434 |
| 5,435,403 | 7/1995 | Tibbitts | 175/432 |
| 5,437,343 | 8/1995 | Cooley et al. | 175/431 |
| 5,443,565 | 8/1995 | Strange, Jr. | 175/431 |
| 5,460,233 | 10/1995 | Meany et al. | 175/428 |
| 5,469,927 | 11/1995 | Criffin | 175/432 |
| 5,472,376 | 12/1995 | Olmstead et al. | 451/540 |
| 5,486,137 | 1/1996 | Flood et al. | 451/540 |
| 5,494,477 | 2/1996 | Flood et al. | 451/540 |
| 5,544,713 | 8/1996 | Dennis | 175/434 |
| 5,564,511 | 10/1996 | Frushour | 175/431 |

FOREIGN PATENT DOCUMENTS

| | | | |
|---|---|---|---|
| 2 240 797 | 8/1991 | United Kingdom | E21B 10/46 |
| 2 290 326 | 12/1995 | United Kingdom | E21B 10/45 |
| 2 290 327 | 12/1995 | United Kingdom | E21B 10/46 |
| 2 290 328 | 12/1995 | United Kingdom | E21B 10/46 |

*Primary Examiner*—Roger Schoeppel
*Attorney, Agent, or Firm*—Lloyd W. Sadler

[57] ABSTRACT

Polycrystalline diamond cutter (PDC) designs which substantially improve the penetration rate of fixed cutter drill bits while simultaneously reducing the wear on the bit during drilling operations are disclosed. The designs are based upon the observation that: 1) the wear pattern of a PDC is roughly a conic section and is parallel to bit rotation, and 2) the cutting surface is perpendicular to the rotation of the bit. The inventive PDC designs provide cutting action both perpendicular and parallel to the direction of bit rotation.

18 Claims, 5 Drawing Sheets

Where:

$$S = \sqrt{4x^2 + y^2} + \frac{y^2}{2x} \quad \text{Log}_e \left[ \frac{2x + \sqrt{4x^2 + y^2}}{y} \right]$$

and the area of the wear scar is:

$$K \text{ (area)} = \frac{4}{3} xy$$

CUTTER WITH POLYCRYSTALLINE DIAMOND LAYER AND CONIC SECTION PROFILE

This application claims the benefit of U.S. Provisional Application Ser. No. 60/018,263, filed on May 24, 1996.

I. BACKGROUND OF THE INVENTION

A. Field of the Invention

This invention relates to the design of cutters used in fixed cutter drill bits such as are used for drilling holes for blasting, and oil and gas exploration and production. In particular, this invention relates to cutters for use on rotary drag bits which are configured to maximize wear resistance and to enhance drill bit performance.

B. The Background Art

It is known in the prior art to construct drill bits for drilling holes in rock formations by affixing a plurality of discrete cutting elements made of a superhard material (typically diamond) to a substrate of some other material, such as tungsten carbide. In the past, chips of diamond set in the surface of a drill bit, as disclosed by Havlick (U.S. Pat. No. 2,264,440) have been used. More recently it has become common for drill bits to include cutting elements which are composites of a substrate material (e.g. tungsten carbide) and a superhard material (e.g. polycrystalline diamond). The superhard material most often serves as a surface material, but may also be used in internal reinforcing structures. These composite cutting elements are usually in the form of either short, cylindrical "compacts" which are used primarily in rotary drag bits, or buttons or inserts which are used in rolling cone or percussion bits.

The simplest form of compact is simply a short cylinder (typically with a diameter greater than its height) of substrate material with a uniform layer of superhard material on one face. This type of compact is described in the patents of Daniels (U.S. Pat. No. 4,156,329) and Bovenkerk (U.S. Pat. No. 4,268,276). The superhard material provides a wear resistant cutting edge. Buttons and inserts may also be constructed with a superhard surface over a substrate material (Waldenstrom, U.S. Pat. No. 5,335,738 and Keshavan, U.S. Pat. No. 5,158,148).

Prior art improvements to the basic compact design include modifications to the interface between the substrate and the superhard material. Many previous patents describe modifications to the interface geometry which improve the transfer of stresses between the different materials, e.g,. patterns of linear ridges as disclosed by Dennis (U.S. Pat. Nos. 4,592,433 and 5,120,327), Aronssen (U.S. Pat. No. 4,764,434) and Hall (U.S. Pat. No. 4,629,373), or ridges extending radially outward (Flood, U.S. Pat. No. 5,486,137; Smith, U.S. Pat. No. 5,351,772; and Dennis, U.S. Pat. Nos. 5,379,854 and 5,544,713). Hardy et al (U.S. Pat. No. 5,355,969) describe a cutter design having a concentric pattern of ridges at the interface. Matthias et al. (U.K Patent No. 2,290,328) disclose cutters having various patterns of ridges at the interface in the region of the cutting edge. Matthias (U.K. 2,290,327) discloses a cutter with a star-shaped pattern of ridges which extend into the substrate.

Projections which extend from the substrate into the superhard surface (Waldenstrom, U.S. Pat. Nos. 5,217,081 and 5,335,738), Frushour (U.S. Pat. No. 5,564,511), Hardy (U.S. Pat. No. 5,355,969) or from the surface into the substrate (Griffin, U.K. Patent No. 2,290,326) have also been disclosed. These projections are generally rounded; however, Griffin (U.S. Pat. No. 5,469,927) has also disclosed a cutter with an array of star-shaped projections which extend into the cutting surface from the substrate.

Other prior art compacts have a cutting surface of superhard material which is thicker at the center of the cutter so that it projects into the substrate (Olmstead, U.S. Pat. No. 5,472,376). Alternatively, the superhard material may be thickest about the circumference of the compact (Flood et al., U.S. Pat. No. 5,486,137), on opposite sides of the compact (Tibbitts, U.S. Pat. No. 5,435,403), or on one side only (Flood et al., U.S. Pat. No. 5,494,477). In the Flood and Tibbitts patents, the thickness of the superhard material increases linearly from the central region of the cutter to the outer edge. These modifications to the geometry of the superhard layer are intended to reduce residual stresses in the cutter and thus reduce wear. In addition, by increasing the thickness of the superhard layer at the circumference of the cutter, where the most wear occurs, the lifetime of the cutter is increased. Other approaches to increasing the strength of compacts are to use polycrystalline diamond in reinforcing rods (Tibbitts et al., U.S. Pat. No. 5,279,375) or as a cylindrical core (Bovenkerk, U.S. Pat. No. 4,268,276). According to these references, the use of polycrystalline diamond inside a cutting element serves to reduce residual stresses.

A further prior art method for making the cutting action of a standard diamond table more effective is to use a "scribing" action. This can be accomplished by including pointed cutting elements on a drill bit along with cylindrical cutters, so that the pointed cutters cut grooves or kerfs into the rock surface so that it can be more easily cut by the blunter cylindrical cutters. This approach is described by Weaver (U.S. Pat. No. 4,602,691). Another approach is to wire electric discharge machine a point (parallel to bit rotation) into a standard polycrystalline diamond cutter (PDC), thus combining the scribing and standard cutting action in a single cutter. However, this cutter design has no additional diamond to provide greater wear resistance to the point and, consequently, the point is worn down in the first few hours of drilling. A scribing effect has also been attributed to DBS's "claw" cutters, as described in Dennis (U.S. Pat. No. 4,784,023). The "claw" cutter addresses the wear problem by providing additional diamond, but the parallel cutting action provided by the small diamond-filled grooves is minimal at best.

Each of the above patents is hereby incorporated by reference in its entirety.

II. BRIEF SUMMARY AND OBJECTS OF THE INVENTION

The invention is a compact-type cutter for use in fixed-cutter rotary drag bits. An example of such a drag bit is depicted in FIG. 1. The cutter is a composite having a polycrystalline diamond cutting surface on a carbide substrate. The polycrystalline diamond forms a layer which covers one face of the cutter and extends into the central portion of the cutter as a ridge-like structure. On the side of the cutter, the ridge-like structure presents a parabolic region of polycrystalline diamond which extends downward from the face of the cutter. The parabolic region of diamond corresponds to the region of the cutter in which a wear scar (or wear flat) would be formed during the drilling operation. By constructing this region of the cutter with a harder material (i.e., diamond rather than carbide), wear on the cutter is reduced and cutting action and lifetime of the cutter are improved. An example of one embodiment of the inventive cutter design is shown in FIGS. 6*a*–6*c*.

The actual shape of the wear scar formed on a cutter is determined by several factors. In the least complex case, the polycrystalline diamond cutter can be approximated by a cylinder. A cylinder may also be viewed as a cone whose vertex has been moved to infinity. Therefore, in the drilling process the wear flat may be approximated by some type of a conic section, either a portion of an ellipse, or a parabola. If the cutter was a true cylinder and was composed of a uniform material, then the wear scar would simply be a section of an ellipse whose general dimensions would be determined by the angle at which the cutter contacts the rock. To form the full ellipse, the cutter would have to be lengthened proportional to the rake angle or angle of contact with the workpiece. However, in reality, a polycrystalline diamond cutter is not a true cylinder but is slightly tapered (approximately 0.3% taper), such that if the cutter is lengthened toward infinity, it would eventually become a cone. Also, in current bit designs, cutting inserts have a back rake angle generally between 10 and 30 degrees from perpendicular to the workpiece surface. This taper becomes more of a factor in the shape of the wear scar as the back rake angle becomes smaller (i.e. the diamond face of the cutter becomes almost perpendicular and the cutter side becomes almost parallel to the rock). Therefore, the larger the back rake angle, the more the wear scar will appear to be a segment of an ellipse. Similarly, the smaller the back rake angle, the more the wear scar will have a tendency to move toward a parabola because of the effect of cutter taper. In addition to cutter taper, another factor which effects the shape of the wear flat is that the cutter is composed of a leading edge diamond layer on a tungsten carbide substrate. The difference in abrasion resistance between the two materials distorts the shape of the wear flat. In general, because the diamond layer wears slower than the carbide substrate, the wear scar elongates faster than it widens making it look more parabolic. It should be noted that neither an ellipse or a parabola is the true wear scar shape, but are only approximations to the wear flat pattern observed on cutters from a used drill bit. For this reason, the use of a parabolic shape to describe the wear flat is considered only as an approximation to the best shape of this invention and a segment of an ellipse or a variety of other shapes may be employed.

It is an object of the present invention to provide a cutter having an extended lifetime and increased abrasion and impact resistance for use in rotary drag bits. This is accomplished by using a diamond layer in the entire wear region to slow wear of the cutter. Longer cutter life means less frequent replacement of cutters and fewer bits overall will be required to drill holes, thereby saving time and money.

It is a further object of the present invention to provide a cutter which provides cutting action both parallel and perpendicular to the direction of bit rotation. This is accomplished by providing a cutter with a layer of diamond on its face and extending down its side. This gives improved cutting action over the lifetime of the cutter. Moreover, if a sharp cutting edge is maintained, the weight on the drill bit does not need to be increased as much over the lifetime of the bit to produce constant pressure on the cutter surface, as in bits in which prior art cutters are used.

Another object of the invention is to provide a cutter in which minimal diamond is used in the area of the cutter which is brazed to the drill bit on which it is to be used. This is accomplished by placing diamond only on the regions of the cutter which experience the most wear. This has the advantage of maximizing the braze alloy coverage, thus facilitating the formation of a strong attachment of the cutter to the drill bit.

Another object of the invention is to provide a cutter which has a "scribing" action. This is accomplished by forming a diamond region in the area of the developing wear scar, which is narrower than the wear scar that would be predicted to develop on the cutter, so that the generally parabolic diamond region cuts into the surface being drilled, thus decreasing its strength so that it may be more easily cut by the face of the cutter.

Another object of the invention is to provide a larger surface area for attachment of the diamond to the carbide in the cutter. The generally parabolic portion of the diamond layer provides said larger surface area. The larger surface area results in a better attachment between the diamond and carbide.

Another object of the invention is to provide for greater heat transfer from the cutter. This is achieved by using a substantial amount of additional diamond, which is a much better thermal conductor than tungsten carbide (or other substrate materials), in the region of the cutter which contacts the material which is being cut. This has the benefit that the cutter does not overheat, thus reducing wear.

Another object of the invention is to reduce the surface friction between the cutter and the rock by providing a diamond-rock contact surface rather than a higher friction carbide-rock contact surface. The higher friction produced with a carbide contact surface generates excessive heat which results in heat checking and subsequent failure of the carbide; these problems are reduced or eliminated by the use of a diamond contact surface.

Another object of the invention is to provide a diamond-carbide interface which does not have stress risers. This is achieved with the use of the modified generally parabolic configuration described herein. The chance of cracks being formed at the diamond-carbide interface is thus reduced.

These and other objects of this invention are intended to be covered by this disclosure and are readily apparent to individuals of ordinary skill in the art.

III. BRIEF DESCRIPTION OF THE DRAWINGS

Figure 6A:
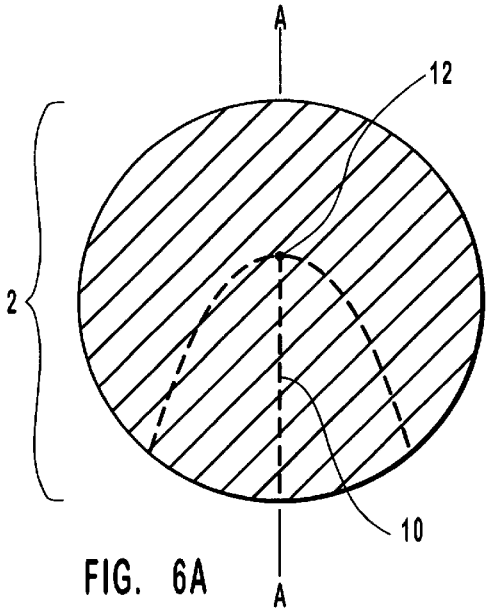
Figure 6B:
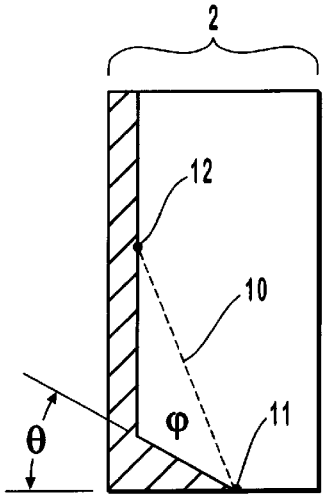
Figure 6C:
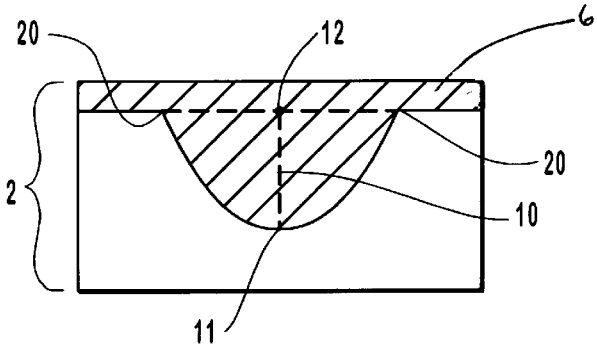
Figure 7A:
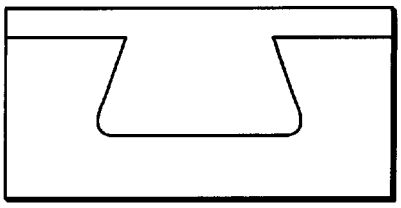
Figure 7B:
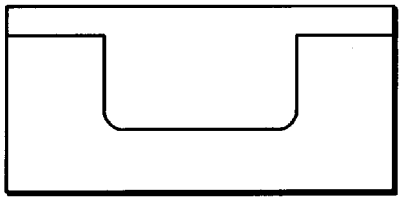
Figure 7C:
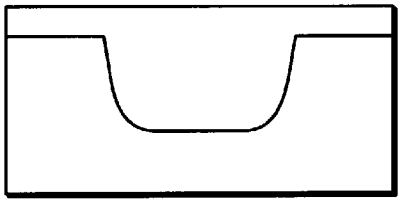
Figure 7D:
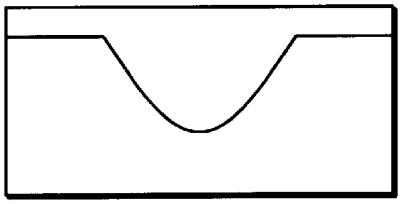
Figure 7E:
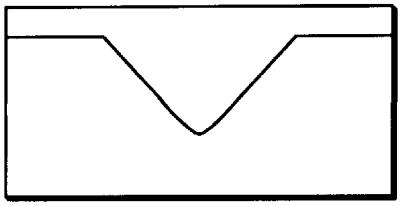
Figure 7F:
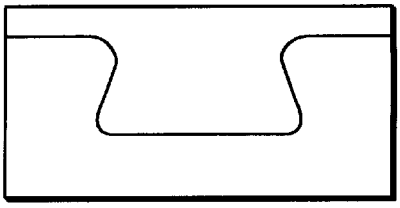
Figure 7G:
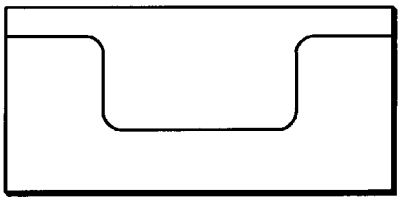
Figure 7H:
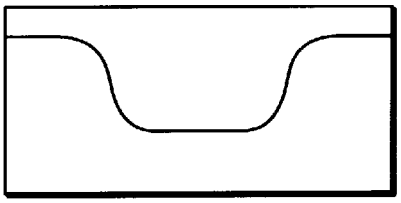
Figure 7I:
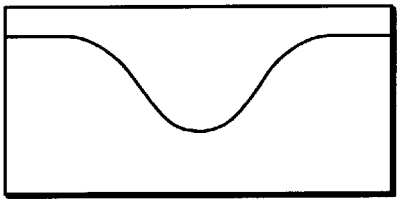
Figure 7J:
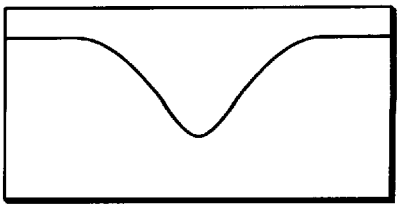

FIGS. 6*a*, 6*b*, and 6*c* show top and side views of a the cutter with a simple parabolic diamond region.

FIGS. 7*a*–7*j* show alternative cross-sectional shapes for the ridge of polycrystalline diamond.

Figure 8:
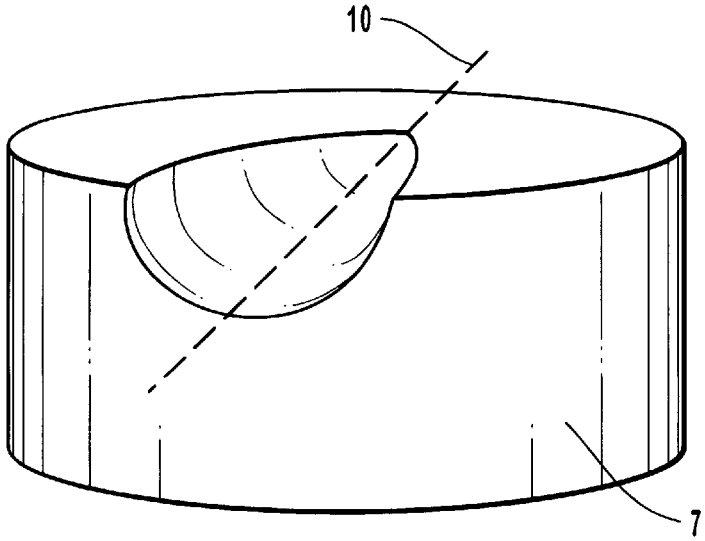

FIG. 8 illustrates a substrate used in the manufacture of the cutter shown in FIGS. 6*a* through 6*c*.

Figure 9A:
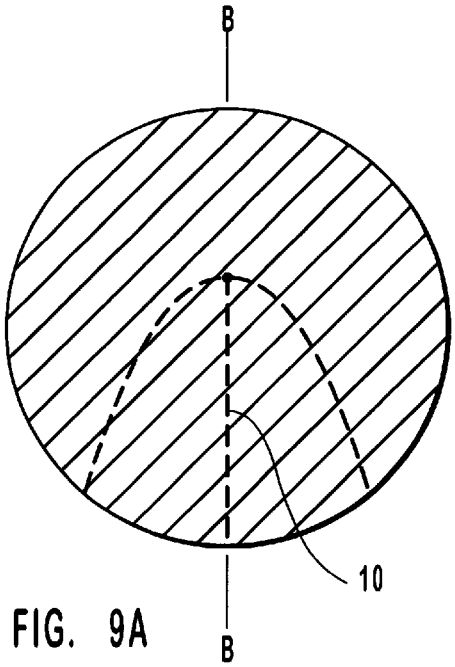
Figure 9B:
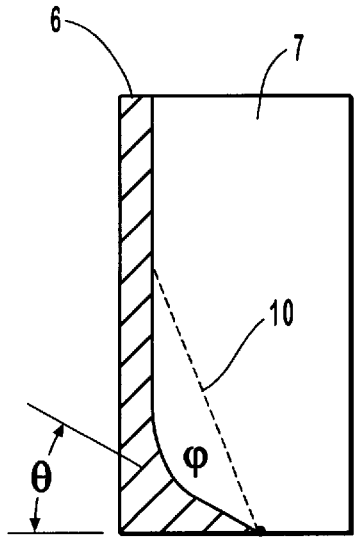
Figure 9C:
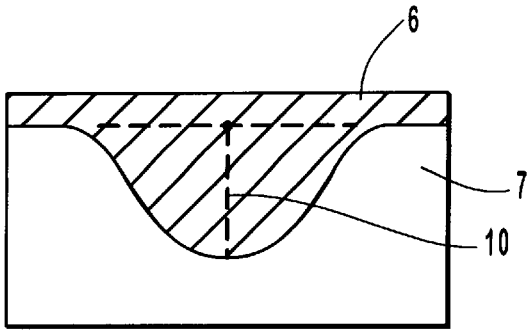

FIGS. 9*a*, 9*b*, and 9*c* show top and side views of a the cutter with a modified parabolic diamond region.

IV. DETAILED DESCRIPTION OF THE PREFERRED EMBODIMENT

Figure 1:
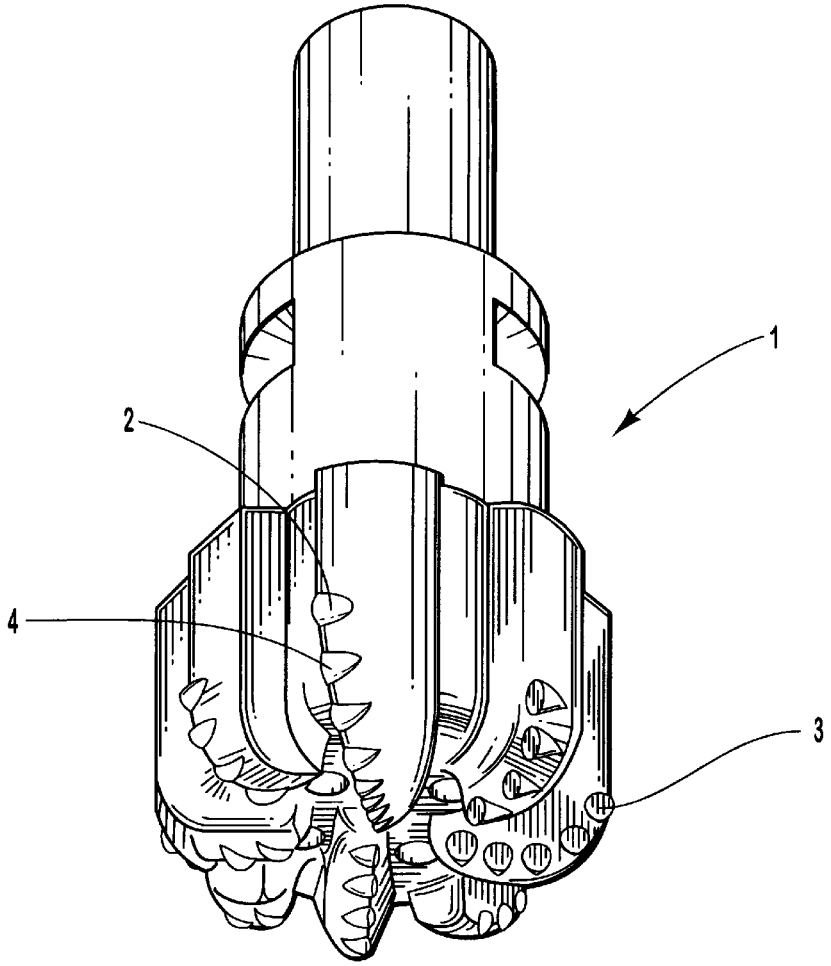
FIG. 1 (PRIOR ART)
FIG. 1 depicts rotary drag bit [prior art] with disk-shaped cutters.

The inventive cutter is intended for use in cutting tools such as the rotary drag bit 1 shown in FIG. 1. Each cutter 2 is brazed into the drill bit such that the face 3 of the cutter is perpendicular to the rotation direction of the bit (as indicated by the arrow) When the drill bit is rotated, the leading edge 4 of each cutter contacting the rock surface performs a cutting action on the rock surface. In the bit depicted in FIG. 1, numerous cutters are arranged on the bit such that there is enough overlap between the areas cut by the different cutters that the entire surface of the rock face is being acted upon.

Figure 2:
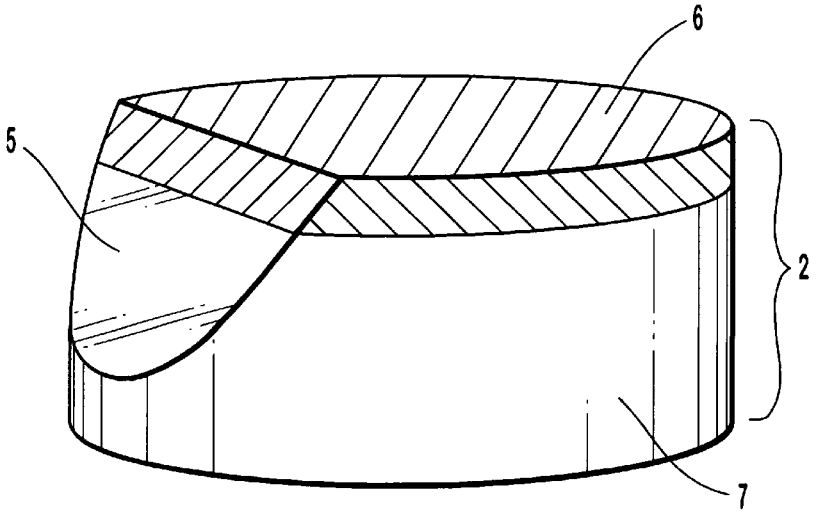
FIG. 2 depicts the wear scar developed on a cutter used in a rotary drag bit.

As the drilling process proceeds, the working edge of each cutter begins to wear and forms a wear scar 5 as depicted in FIG. 2. The cutter shown in FIG. 2 includes a polycrystalline diamond layer 6 and a substrate 7. In reality, a composite cutter of the type shown in FIG. 2 does not form a perfectly planar wear scar; instead, the substrate region will be slightly undercut below the polycrystalline diamond layer and the wear scar becomes slightly elongated and thus parabolic in shape rather than ellipsoid as would be the case if the wear scar was perfectly planar.

During the drilling operation, the capacity of a cutter to dig into the rock surface is roughly proportional to the pressure at the cutting edge. Initially, the cutting edge has a small surface contact area and the pressure at the cutting edge is very high, resulting in an aggressive cutting action and, therefore, a high penetration rate. If the weight on the bit is kept constant as the cutting edge wears, the contact pressure begins to decrease proportional to the increase in surface contact area, and the cutting action is decreased. In order to maintain the penetration rate, the weight on the bit must be increased. Once the cutter has worn down to its midsection, the wear scar has developed to its maximum size, and it is typically not possible to increase the weight on the bit enough to provide a sufficient penetration rate, due to limitations of the drill string integrity or the structural integrity of the bit itself. Also, at this point it becomes difficult to retain the cutters in their pockets. The drill bit is now at the end of its useful life.

In the present invention, the performance of a fixed cutter bit is improved by providing a cutter which maintains the smallest possible wear surface while simultaneously maintaining a sharp cutting edge against the rock surface during its lifetime. This is accomplished by maximizing the amount of a diamond at the developing wear scar in such a way as to provide cutting action both perpendicular and parallel to the direction of a bit rotation.

Diamond is used on the area in which the wear scar will develop, rather than on the entire perimeter of the cutter, with the advantage that the areas of the cutter which are to be brazed to the bit body are tungsten carbide, which can be readily brazed to the bit body. Polycrystalline diamond is not wetted by braze, and therefore, additional diamond around the perimeter of the cutter reduces the wettable area of the cutter, resulting in a weaker bond of the PDC to the bit body. In the prior art cutters of Smith (U.S. Pat. No. 5,351,772) and Flood et al. (U.S. Pat. No. 5,486,137), the diamond layer is thickest at the outer edge of the cutter and radially symmetrical, which means that diamond is present on the side of the cutter which is brazed to the bit body, thereby weakening the bond between cutter and bit body. In the inventive cutter, the side of the cutter which is brazed to the bit body is similar to standard flat interface PDC cutters, which can be bonded easily and securely to the bit body.

In the inventive cutter, the layer of polycrystalline diamond (or other superhard material) approximates the area of the developing wear scar. The polycrystalline diamond extends into the interior of the compact as a ridge with a curved profile. Although one previous cutter design of which we are aware (Flood et al., U.S. Pat. No. 5,494,477) includes a diamond layer which is thicker on one side, the interface differs in that it slopes linearly downward from a line which is a chord of the circular compact. The interface is thus planar; when the wear scar has developed far enough to cut through the interface into the substrate, the cutting performance of the cutter deteriorates and the substrate material is worn away. In contrast, the ridge of polycrystalline diamond in the inventive cutter has a curved, rather than planar profile, and is not constrained to extend from the center of the cutter radially to the edge In the preferred embodiment of the present invention, the parabolic ridge extends beyond the center of the cutter, so that a parabolic diamond region remains even when the cutter has worn to the mid-point.

Two examples of the inventive cutter design are now described. Further modifications may be made without departing from the essential nature of the invention and such modifications are considered to fall within the scope of this patent.

EXAMPLE I

Simple Parabolic Cutting Surface

Figure 3:
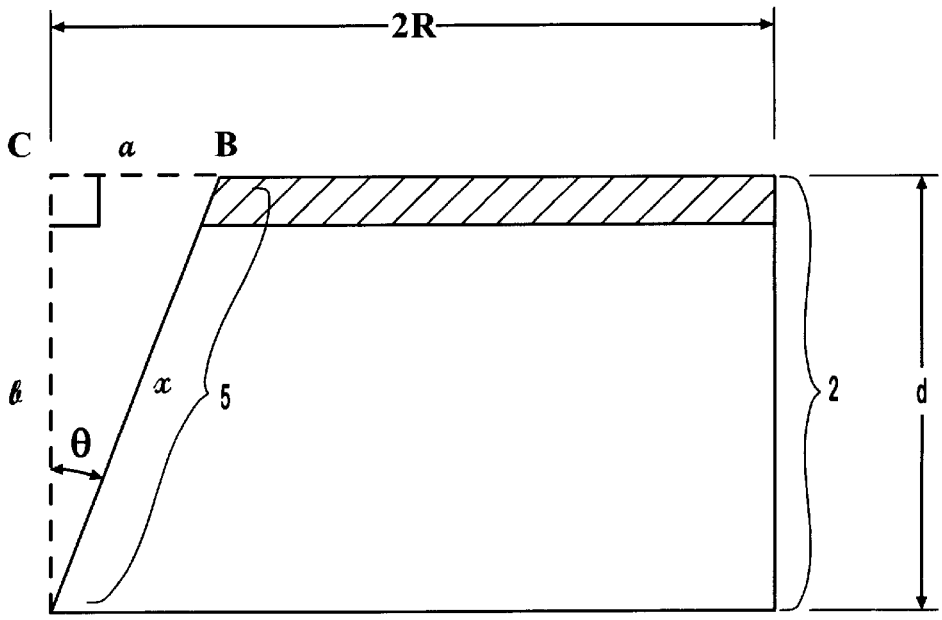
FIG. 3 is a side view of the cutter with a wear scar depicted in FIG. 2.

This embodiment of the invention is depicted in FIGS. 6*a*–6*c*. The cutter is essentially cylindrical in shape. The inventive cutter has a layer of polycrystalline diamond 6 on a substrate 7. The polycrystalline diamond layer serves as a cutting surface. The cutting surface includes a surface layer which covers on face of the cutter, and, contiguous with the surface layer, a ridge of polycrystalline diamond extending into the substrate. On the side of the cutter, the end of the ridge (seen in cross section) approximates the shape of the wear scar; however, the polycrystalline diamond is not simply a surface feature but extends well into the substrate. This design is based on the theory that the simplest way to prevent a large wear scar from developing is to place a substantial amount of the most wear resistant material (e.g. diamond) in the area of the cutter where the wear scar will develop. Since the wear scar is essentially parabolic in shape, the additional diamond wear is also parabolic in shape. Prior to calculating the size of the parabolic region, the maximum parabolic wear scar must be determined. As shown in FIG. 3, in side view (looking perpendicular to the longitudinal axis of the cutter and parallel to the wear scar), if the simplifying assumption is made that the wear scar is planar, wear scar 5 is defined by a right triangle. The basic shape of the maximum wear scar can be determined from the contact angle θ (which is the rake angle of the cutter mounted in the bit), the depth of the wear scar as measured along the outside diameter of the cutter, and the maximum width as measured at the top of the diamond layer.

The maximum possible wear scar has a depth d which is the same as the height b of the cutter. The angle θ is defined as the back rake angle. x is the surface length of the wear scar. a, b, and x define a right triangle, so $$a=b\tan\theta \qquad \text{EQN. 1}$$

and $$x=b/\cos\theta \qquad \text{EQN. 2}$$

Figure 4:
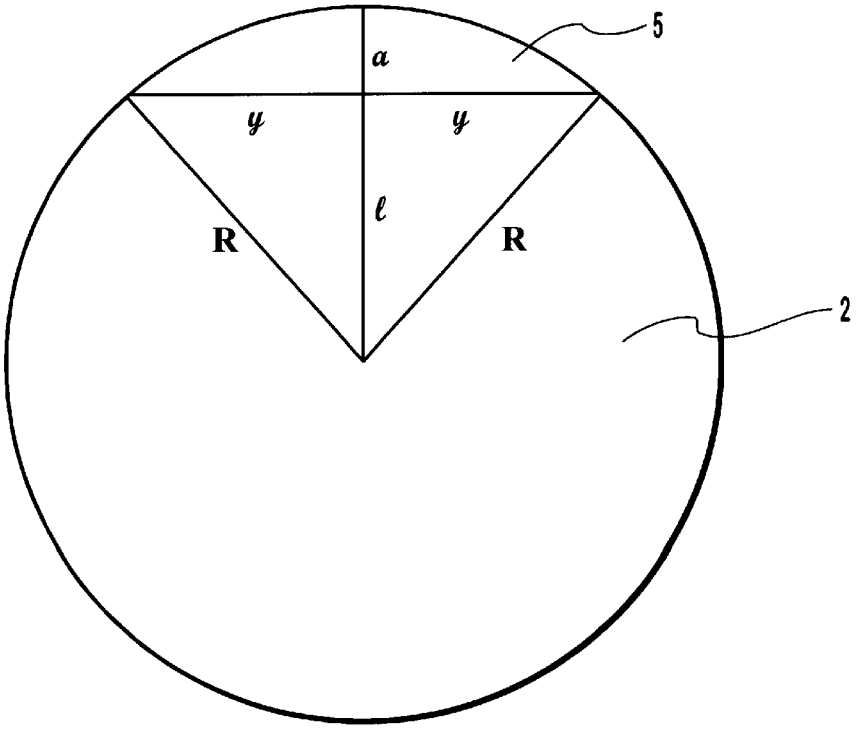
FIG. 4 is a top view of a cutter with a wear scar, showing calculation of the dimensions of the maximum wear scar.

Thus a and x can be solved for in terms of b and θ. FIG. 4 shows a top view of the cutter, including the wear scar. The half width of the wear scar on the top of diamond surface is:

$$y=(R^2-l^2)^{1/2} \qquad \text{EQN. 3}$$

where $$l=R-a \quad \text{EQN. 4}$$

with R being the radius of the cutter. Substituting EQN. 1 and EQN. 4 into EQN. 3, the following is obtained:

$$y=(2R(b\tan\theta)-(b\tan\theta)^2)^{1/2} \quad \text{EQN. 5}$$

Figure 5:
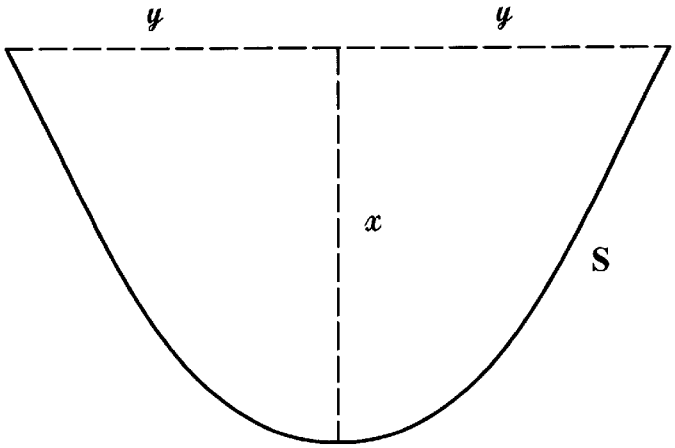
FIG. 5 is a plot of a simple parabola, showing how depth and width define the shape of the parabola.

Thus, x and y can be solved from R, b, and θ, which are known for a given cutter. FIG. 5 illustrates a typical parabola with x and y labeled. The area k and length of arc s can be calculated as follows:

$$k=\frac{4}{3}xy \quad \text{EQN. 6}$$

and $$s=\sqrt{4x^2+y^2}+\frac{y^2}{2x}\mathrm{Log}_e\left[\frac{2x+\sqrt{4x^2+y^2}}{y}\right] \quad \text{EQN. 7}$$

If it is assumed that an industry standard cutter having a height of b=8 mm and a diameter of 13 mm (so R=7.5 mm) is used, with a rake angle of 20°, the maximum parabolic wear scar will have dimensions x=8.5 mm and y=5.92 mm. In the preferred embodiment of the invention, the parabolic region will be somewhat smaller than the maximum wear scar.

As noted previously, the generally parabolic shaped region of diamond in the cutter is actually a ridge which extends from the perimeter to the interior of the cutter. The parabolic region visible on the surface of the cutter is one end of the ridge of superabrasive material, preferably having a parabolic cross section, which extends through the body of the cutter, as shown in FIGS. 6*a*–6*c*. The dimensions of the parabolic ridge through the cutter may be varied as needed. However, keeping the ridge within the limits of the maximum parabolic wear scar is thought to provide the best results. The apex of the ridge is defined by line 10 that at one end intersects the perimeter of the cutter at a point 11 at the diamond-carbide interface, above the base of the cutter, and at the other end intersects the diamond-carbide interface (point 12), either in the interior of the cutter (as shown), or on the perimeter of the cotter opposite point 11, or at some intermediate point. Line 10 makes an angle ϕ with the longitudinal axis of the cutter, as shown in FIGS. 6*a*–6*c*. In the preferred embodiment of the invention, angle ϕ will be substantially greater than the rake angle θ, which is typically 20°. Angle ϕ is generally in the range of 10 to 80 degrees. In the preferred embodiment of the invention, ϕ will be between of 20 and 70 degrees. It is most preferred that ϕ will be between 30 and 60 degrees. If ϕ were the same as θ, the diamond-carbide interface at the apex of the ridge would be substantially parallel to the direction of rotation of the bit, causing the interface to experience high shear loads which might delaminate the diamond region from the carbide. It is believed that ϕ should be two to three times rake angle θ. At a minimum, angle ϕ should be chosen such that the diamond ridge extends to the middle of diamond table. This allows for some of the parabolic ridge to still be present when the cutter is worn to the mid-point.

The parabolic diamond region on the side of the cutter is parallel to the direction of rotation of the bit, and the first order effect is to provide greater wear resistance. A variation of this idea is to make the parabolic diamond ridge narrower than the generally parabolic wear scar that will be produced during drilling. As this cutter wears, the difference in abrasion resistance between the diamond and the carbide substrate will cause the diamond ridge to project a small distance above the carbide. The diamond above the carbide should provide a decreased contact area with the rock surface thereby increasing the aggressivity (ratio of normal to axial load) at a given depth of cut. The narrowing of the diamond parabola is achieved by making the value of y smaller than the calculated maximum wear scar halfwidth.

Another important feature of the simple parabolic design is the continuously curved surface of the parabola. The curved surface provides increased surface area for diamond-to-carbide attachment. In addition, there are no sharp corners to act as stress risers to initiate cracks.

It can be seen in FIGS. 6*a*–6*c* that the thickness of the parabolic section varies across the cutter. The parabola is thickest at one side of the cutter, and gradually becomes thinner toward the center of the cutter. This feature has two benefits: first, the extra diamond is only used where needed, and secondly, only carbide is exposed on the side of the cutter which will be bonded to the drill bit. Concentrating the diamond where it is needed reduces the overall cost of the cutter. From the perspective of cutter attachment, removing the diamond from the bond area permits maximum braze alloy coverage and thus a stronger bond to the bit.

Although the cutter design shown here includes a ridge with a parabolic cross section, the invention is not limited thereto. Some other cross section which approximates the shape of the wear scar could be used as well. Although less preferred, cross sections which do not closely approximate the shape of the wear scar may also be used. Examples of various cross sections which may be used are presented in FIGS. 7*a* through 7*e*. It will be appreciated that cross sectional shapes intermediate between those shown in FIG. 7 may also be used. Although the interface between the surface layer and the substrate are shown as being smooth, it would also be possible to include various mechanical modifications of the surface (e.g. as ridges, undulations, or dimples or chemical modifications to enhance the adhesion and transfer of stresses between the surface and the substrate.

The cylindrical cutter 2 is constructed with a polycrystalline diamond cutting surface 6 on a tungsten carbide substrate 7. Alternatively, materials such as cubic boron nitride or other superabrasive materials could be used in place of polycrystalline diamond as the cutting surface. Materials such as boron tetracarbide, tantalum carbide, vanadium carbide, niobium carbide, halfnium carbide, or zirconium carbide could be used in place of tungsten carbide as the substrate. Superabrasive materials and substrate materials suitable for use in cutters are known in the prior art.

The inventive cutters have a diamond layer 6 formed under high temperature and pressure conditions to a cemented carbide substrate 7 (such as cemented tungsten carbide) containing a metal binder or catalyst such as cobalt. The substrate 7 may be brazed or otherwise joined to an attachment member such as a stud or to a cylindrical backing element to enhance its affixation to the bit face. The cutting element may be mounted to a drill bit either by press-fitting or otherwise locking the stud into a receptacle on a steel-body drag bit, or by brazing the cutter substrate (with or without cylindrical backing) directly into a preformed pocket, socket or other receptacle on the face of a bit body, as on a matrix-type bit.

A PDC is preferably fabricated by placing a disk-shaped cemented carbide substrate with a groove already formed in it into a container or cartridge with a layer of diamond crystals or grains loaded into the cartridge adjacent one face of the substrate. A number of such cartridges are typically loaded into an ultra-high pressure press. The substrates and adjacent diamond crystal layers are then compressed under ultra-high temperature and pressure conditions. The ultra-high pressure and temperature conditions cause the metal binder from the substrate body to become liquid and sweep from the region behind the substrate face next to the diamond layer through the diamond grains and act as a reactive liquid phase to promote a sintering of the diamond grains to form the polycrystalline diamond structure. As a result, the diamond grains become mutually bonded to form a diamond table over the substrate face, which diamond table is also bonded to the substrate face.

The residual stresses mentioned previously, result when the diamond and carbide are bonded at high temperatures and pressures. The cause of the residual stress is the mismatch between the properties of the diamond and the substrate material; in particular, the respective thermal expansion coefficients are different and so are the respective elastic moduli.

Alternatively, the diamond layer may be formed as above, but separately from the substrate, and may subsequently be bonded to the substrate material by brazing with a tungsten or titanium-based braze. Yet another alternative method is to deposit the diamond layer on the substrate by chemical vapor deposition (CVD) processing.

The metal binder may remain in the diamond layer within the pores existing between the diamond grains or may be removed and optionally replaced by another material, as known in the art, to form a so-called thermally stable diamond. The binder is removed by leaching or the diamond table is formed with silicon, a material having a coefficient of thermal expansion similar to that of diamond. Variations of this general process exist in the art, but this detail is provided so that the reader will understand the concept of sintering a diamond layer onto a substrate in order to form a PDC cutter.

In the case of the present invention, the desired parabolic ridge shape is achieved by using a tungsten carbide substrate which has a trough into which the ridge will extend formed into it by the manufacturer. Alternatively, the trough may be cut into the carbide substrate by either grinding or electric discharge machining. The diamond powder fills the trough and is sintered into place during the high pressure and high temperature cycle. An example of such a substrate is shown in FIG. 8.

EXAMPLE II

Modified Parabolic Cutting Surface

A modification of the simple parabolic design is illustrated below in FIGS. 9*a* through 9*c*. The primary focus of this design is to provide as much curved surface as possible to avoid stress concentrations that could cause cracking. This design performs the same functions of the first design. It also illustrates that the curvature of the diamond table may be varied as needed to counter residual stresses which may tear the parabolic region apart. The simple parabolic design has sharp corners 20 (shown in FIG. 6*c*) where the ridge sides intersect the diamond-carbide interface. This design smoothes that area, and cannot be modeled as a simple parabola. The cross-section shapes shown in FIGS. 7*a* through 7*e* can also be modified by the addition of a curved interface region, as shown in FIGS. 7*f* through 7*j*.

The same method is used for manufacturing the modified parabolic cutter as is used for manufacturing the simple parabolic cutter.

As shown in FIGS. 6*b* and 9*b*, in the presently preferred embodiment of the invention, the apex of the ridge of polycrystalline diamond is defined by a line 10. In an alternative embodiment of the invention, the apex of the ridge may be defined by a curve rather than a line. Said curve may be concave upward (i.e., toward the PDC surface of the cutter)or downward, and the curve may have undulations, as well; it is only necessary that the apex of the ridge runs generally upward from point 11 to point 12, as shown in FIG. 6.

The described embodiments are to be considered in all respects only as illustrative and not restrictive. Although the embodiments shown here include a ridge of polycrystalline diamond which has an essentially parabolic cross section, the invention is not limited thereto. The cross section could have any shape which approximates the shape of the wear scar. The scope of the invention is, therefore, indicated by the appended claims rather than by the foregoing description. All changes which come within the meaning and range of equivalency of the claims are to be embraced within their scope.

What is claimed and desired to be secured by Letters Patent is:

1. A cutter comprising:

a) a hard substrate;

b) a cutting surface made of a hard, superabrasive material;

wherein said substrate and said cutting surface together form an essentially cylindrical shape; wherein said cutting surface comprises a surface layer of said hard, superabrasive material on a first face of the cutter and a ridge of said hard, superabrasive material protruding from said surface layer into said substrate; wherein said ridge runs from the interior of said cutter to the perimeter of said cutter; wherein the apex of said ridge is defined as a line which runs from a first point in the interior of said cylinder on the interface between said substrate and said surface layer to a second point on the perimeter of said cutter at a distance from said interface; wherein the cross-section of said ridge approximates the shape of the wear scar which will form on said cutter; and wherein said line forms an angle $\phi$ with the longitudinal axis of the cutter.

2. A cutter in accordance with claim 1 wherein said apex of said ridge is defined by a line.

3. A cutter in accordance with claim 1 wherein said apex of said ridge has a U-shaped cross section.

4. A cutter in accordance with claim 1 wherein said apex of said ridge has an elliptical cross section.

5. A cutter in accordance with claim 1 wherein said ridge has a parabolic cross section.

6. A cutter in accordance with claim 1 wherein said hard, superabrasive material is selected from the group consisting of cubic boron nitride and polycrystalline diamond; and wherein said substrate material is selected from the group consisting of tungsten carbide, boron tetracarbide, tantalum carbide, vanadium carbide, niobium carbide, halfnium carbide, and zirconium carbide.

7. A cutter in accordance with claim 6 wherein said hard, superabrasive material is polycrystalline diamond.

8. A cutter in accordance with claim 6 wherein said substrate material is tungsten carbide.

9. A cutter in accordance with claim 1 wherein $\phi$ is selected so that said second point is in the central region of said cutter.

10. A cutter in accordance with claim 1 wherein $\phi$ is selected so that said second point extends beyond said central longitudinal axis of the cutter.

11. A cutter in accordance with claim 1 wherein the interface between said substrate and said cutting surface is curved in the region where said ridge intersects said surface layer to avoid the formation of stress risers.

12. A cutter in accordance with claim 1 wherein the interface between said substrate and said surface layer is ridged to improve transfer of stresses between said substrate and said surface layer.

13. A cutter in accordance with claim 1 wherein the interface between said substrate and said surface layer has been chemically etched to improve transfer of stresses between said substrate and said surface layer.

14. A cutter in accordance with claim 1 wherein $\phi$ is between 10 and 80 degrees.

15. A cutter in accordance with claim 1 wherein $\phi$ is between 20 and 70 degrees.

16. A cutter in accordance with claim 1 wherein $\phi$ is between 30 and 60 degrees.

17. An apparatus for use in drilling subterranean formations, comprising a body presenting an exterior surface having at least one cutting element secured thereto, said at least one cutting element comprising:

(a) a hard substrate;

(b) a cutting surface made of a hard, superabrasive material; and (c) an interface between said hard substrate and said cutting surface;

wherein said substrate and said cutting surface together form an essentially cylindrical shape; wherein said cutting surface comprises a surface layer of said hard, superabrasive material on a first face of the cutting element, said cutting element having an interior, a perimeter and a longitudinal axis, and a ridge of said hard, superabrasive material protruding from said surface layer into said substrate; wherein said ridge has an apex and a cross section and wherein said ridge runs from said interior of said cutting element to said perimeter of said cutting element; wherein said apex of said ridge is defined by a line which runs from a first point in said interior of the cutting element on said interface between said substrate and said surface layer to a second point on said perimeter of said cutting element at a distance from said interface; wherein said cross-section of said ridge has a shape approximating a shape of a wear scar which will form on said cutting element; and wherein said line forms an angle $\phi$ with said longitudinal axis of the cutting element.

18. A method of manufacturing a cutter in accordance with claim 1, comprising the steps of:

a) placing a disk-shaped cemented carbide substrate into a cartridge;

b) loading a layer of diamond crystals into said cartridge adjacent one face of the substrate;

c) loading said cartridge into an ultra-high pressure press; and d) compressing said substrate and adjacent diamond crystal layer under ultra-high temperature and pressure conditions such that a diamond table is formed over the substrate face, said diamond table also being bonded to said one face of said substrate;

wherein said cemented carbide substrate has a trough-like indentation extending from its central region to its perimeter; and wherein said trough-like indentation is deeper at said perimeter than at said central region.

* * * * *